US007880452B1

(12) United States Patent
Prasad et al.

(10) Patent No.: US 7,880,452 B1
(45) Date of Patent: Feb. 1, 2011

(54) TRIMMING CIRCUIT AND METHOD FOR REPLICA TYPE VOLTAGE REGULATORS

(75) Inventors: Soundararajan Srinivasa Prasad, Bangalore (IN); Damaraju Naga Radha Krishna, La Jolla, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 260 days.

(21) Appl. No.: 11/961,905

(22) Filed: Dec. 20, 2007

Related U.S. Application Data

(60) Provisional application No. 60/877,739, filed on Dec. 29, 2006.

(51) Int. Cl.
*G05F 1/40* (2006.01)

(52) U.S. Cl. ..... 323/282

(58) Field of Classification Search ..... 323/223–225, 323/268, 271, 282, 285, 349–351
See application file for complete search history.

(56) References Cited

U.S. PATENT DOCUMENTS

| | | | | |
|---|---|---|---|---|
| 3,917,993 | A * | 11/1975 | Picmaus et al. | 323/234 |
| 4,282,477 | A * | 8/1981 | Ahmed | 323/312 |
| 2008/0129261 | A1 * | 6/2008 | Oelmaier | 323/273 |

* cited by examiner

*Primary Examiner*—Matthew V Nguyen

(57) ABSTRACT

The present invention is directed to a trimming circuit and method for replica type voltage regulators. A voltage regulator circuit includes an operational amplifier (OPAMP) and a n-type metal oxide silicon (NMOS) device. An output of the OPAMP is coupled to a gate terminal of the NMOS device. The voltage regulator circuit includes a potential divider circuit comprising a plurality of discrete devices coupled in series. A source terminal of the NMOS device is coupled to the potential divider circuit to form an output feedback node. The body of the NMOS device is biased variably across a plurality of tap points formed between consecutive discrete devices in the potential divider circuit.

22 Claims, 5 Drawing Sheets

TRIMMING CIRCUIT AND METHOD FOR REPLICA TYPE VOLTAGE REGULATORS

This application claims priority under 35 U.S.C. §119(e) to U.S. Provisional Application No. 60/877,739, filed on Dec. 29, 2006, the entire contents of which are hereby incorporated by reference herein.

BACKGROUND

1. Field of the Invention

The present invention relates to voltage regulator circuits. More particularly, the present invention relates to a trimming circuit and method for replica type voltage regulators.

2. Background Information

Voltage regulator circuits serve numerous purposes in integrated circuit devices. One such purpose can be as a regulated internal power supply voltage for sections of the integrated circuit device. A replica biased voltage regulator is a type of voltage regulator in which a voltage established in one portion of a circuit (e.g., one leg) is replicated, generally by larger-sized devices, to present a load (output) voltage. The load voltage is regulated by having it track the replica voltage as close as possible.

Conventional replica type voltage regulators use active (dynamic) line regulation and passive (static) load regulation. Such approaches can achieve a good high frequency transient response at the expense of poor DC load regulation. Conventional solutions use permanent or switched dummy loads to improve direct current (DC) load regulation and to prevent overshoots. Conventional solutions provide better control of output voltage over the load current range. One conventional solution uses fast voltage comparators to switch on/off dummy loads or additional current sourcing elements.

FIG. 1 illustrates a conventional replica type voltage regulator circuit in a schematic diagram designated by general reference character 100. The voltage regulator circuit 100 includes an operational amplifier (OPAMP) 101 comprising an n-type metal oxide silicon (NMOS) device 102 which forms the output stage of the OPAMP 101. The voltage regulator circuit 100 further comprises a triple well process scheme in which the bulk of the NMOS device 102 is coupled to its source terminal for improved output regulation. The source terminal of the NMOS device 102 is coupled to a feedback resistor 105 divider network to'form a loop node ($V_{pwr\text{-}loop}$) of the OPAMP 101. The tap point of the feedback resistor divider network 105 is further fed back to the input of the OPAMP 101 to form a closed loop path. The OPAMP 101 is coupled to an output transistor 103 that has a source terminal forming the output node ($V_{pwr}$) of the voltage regulator circuit 100. A load current source 104 coupled to the output node acts as an internal leakage path for the voltage regulator circuit 100. The OPMAP 101 is enabled with a reference voltage ($V_{REF}$) that is compared with the closed loop to generate an NGATE output voltage that further provides a regulated voltage at the output node ($V_{pwr}$). The resistor divider network 105 and the load current source 104 together contribute to the tuning of the circuit to provide a regulated output voltage ($V_{pwr}$).

FIG. 2 illustrates another conventional replica type voltage regulator circuit in a schematic diagram designated by general reference character 200. The voltage regulator circuit 200 includes an OPAMP device 201, an NMOS device 202, an output transistor device 203, and a load current source 204. The voltage regulator circuit 200 is similar in structure and function as the voltage regulator circuit 100 illustrated in FIG. 1, except that the feedback resistor divider circuit is replaced by discrete elements to provide finer tuning of the regulator output voltage ($V_{pwr}$). The discrete elements are comprised of transistors and designated as 205, 206, 207, 208 and 209. Divider tap points tp1, tp2, tp3 and tp4 are formed between consecutive discrete elements (e.g., divider tap point tp1 is formed between discrete elements 205 and 206 divider tap point tp2 is formed between discrete elements 206 and 207, divider tap point tp3 is formed between discrete elements 207 and 208, and divider tap point tp4 is formed between discrete elements 208 and 209). The divider tap points tp1-tp4 are fed back in steps to the OPAMP 201 input (e.g., via feedback path "fdbk").

Disadvantages of the conventional tuning methods illustrated in. FIGS. 1 and 2 include that the feedback resistor network must be continuous so that any fractional load variations can be achieved by sliding the tap point along the feedback network. A further disadvantage is that when the feedback resistor network is replaced by discrete elements, such as transistor devices, the step size of tuning is very high, thereby leading to course variations in the output voltage ($V_{pwr}$). Another disadvantage is that tuning the default load current source at the regulator output node consumes excessive power.

SUMMARY OF THE INVENTION

A trimming circuit and method for replica type voltage regulators are disclosed. In accordance with exemplary embodiments of the present invention, according to a first aspect of the present invention, a voltage regulator circuit includes an operational amplifier (OPAMP) and a n-type metal oxide silicon (NMOS) device. An output of the OPAMP is coupled to a gate terminal of the NMOS device. The voltage regulator circuit includes a potential divider circuit comprising a plurality of discrete devices coupled in series. A source terminal of the NMOS device is coupled to the potential divider circuit to form an output feedback node. A body of the NMOS device is biased variably across a plurality of tap points formed between consecutive discrete devices in the potential divider circuit.

According to the first aspect, the body of the NMOS device can be biased in steps along the plurality of tap points of the potential divider circuit to fine tune an output voltage of the voltage regulator circuit. According to an exemplary embodiment of the first aspect, the plurality of discrete devices can comprise, for example, a plurality of transistor or other like devices. An output from a tap point formed between consecutive discrete devices can be fed back to an input of the OPAMP as a feedback voltage. The feedback voltage can be configurable by tuning a closed loop feedback node along the plurality of tap points of the potential divider circuit.

According to the first aspect, the voltage regulator circuit can include an output power transistor. The output power transistor can comprise a drain terminal coupled to common dram terminals of the OPAMP and the NMOS device. A gate terminal of the output power transistor can be coupled to an output of the OPAMP. A source terminal of the output power transistor can be coupled to a current source to form an output node of the voltage regulator circuit. A body of the output power transistor can be biased variably across the plurality of tap points along the potential divider circuit. The body of the output power transistor can be biased in steps along the plurality of tap points of the potential divider circuit to fine tune an output voltage of the voltage regulator circuit. The OPAMP can be configured to compare a reference voltage and a feedback voltage from a tap point of the potential divider circuit to alter an output signal of the OPAMP. The output signal can be applied to the gate terminal of the output power transistor. The output signal can be configured to alter an output voltage at the output node of the output power transistor. The output signal can be applied to the gate terminal of the NMOS device. The output signal can be configured to alter an output voltage at the output feedback node associated with the NMOS device.

According to a second aspect of the present invention, a method of operating a voltage regulator comprises the steps of a.) coupling an output of an OPAMP to a gate terminal of a NMOS device, b.) coupling a source terminal of the NMOS device to a potentials divider circuit to form an output feedback node, wherein the potential divider circuit comprises a plurality of discrete devices coupled in series, and c.) variably biasing a body of the NMOS device across a plurality of tap points formed between consecutive discrete devices in the potential divider circuit.

According to the second aspect, the method can include the step of biasing the body of the NMOS device in steps along the plurality of tap points of the potential divider circuit to fine tune an output voltage of the voltage regulator. According to an exemplary embodiment of the second aspect, the plurality of discrete devices can comprise, for example, a plurality of transistor or other like devices. The method can include the step of feeding hack an output from a tap point formed between consecutive discrete devices to input of the OPAMP as a feedback voltage. The method can include the step of configuring the feedback voltage by tuning a closed loop feedback node along the plurality of tap points of the potential divider circuit.

According to the second aspect, the method can include the steps of: coupling a drain terminal of an output power transistor to common drain terminals of the OPAMP and the NMOS device; coupling a gate terminal of the output power transistor to an output of the OPAMP; and coupling a source terminal of the output power transistor to a current source to form an output node of the voltage regulator. The method can include the step of variably biasing a body of the output power transistor across the plurality of tap points along the potential divider circuit. The method can also include the step of biasing the body of the output power transistor in steps along the plurality of tap points of the potential divider circuit to fine tune an output voltage of the voltage regulator circuit. The method can further include the step of comparing a reference voltage and a feedback voltage from a tap point of the potential divider circuit to alter an output signal of the OPAMP. The method can include the step of altering an output voltage at the output node in accordance with the output signal. The output signal can be applied to the gate terminal of the output power transistor. The method can include the step of altering an output voltage at the output feedback node associated with the NMOS device in accordance with the output signal. The output signal can be applied to the gate terminal of the NMOS device.

According to a third aspect of the present invention, a method of operating a voltage regulator includes the steps of coupling an OPAMP output to a gate of an NMOS device forming an NGATE node of the OPAMP, and coupling a source path of the NMOS device to a potential divider circuit forming an output feedback node of the OPAMP.

According to the third aspect, the method can include the steps of coupling a drain path of an output power transistor to common drain paths of the OPAMP and the NMOS device, coupling a source path of the output power transistor to a current source forming an output node, and coupling a gate path of the output transistor to the NGATE node. The method can include the step of biasing a body of the NMOS device along a plurality of tap points along the potential divider circuit. The method can also include the step of biasing a body of the output power transistor along the plurality of tap points along the potential divider circuit. The method can further include the step of feeding back a variable feedback voltage to the OPAMP input through a closed loop feedback path. The method can include the step of enabling the OPAMP input with a reference voltage and a feedback voltage. According to an exemplary embodiment of the third aspect, the step of biasing the body of the NMOS device can change or otherwise modify or alter a voltage of the NGATE node through closed loop feedback path of the OPAMP to provide finer tuning of the output voltage. Additionally, the step of biasing the body of the output power transistor device can alter the NGATE node through the closed loop feedback path of the OPAMP to provide finer tuning of the output voltage.

According to a fourth aspect of the present invention, a voltage regulator circuit includes structure for trimming an output voltage of a voltage regulator by body biasing an NMOS device and an output power transistor via a plurality of tap points of a potential divider circuit. The circuit includes structure for enabling an OPAMP input with a reference voltage and a feedback voltage from a closed loop feedback node. The circuit includes structure for altering the feedback voltage via the potential divider circuit and for feeding back the voltage to the OPAMP input. The circuit includes structure for changing the voltage of the NGATE node of the output of the OPAMP to thereby alter an output feedback node associated with the NMOS device and the output voltage of the voltage regulator circuit.

BRIEF DESCRIPTION OF THE DRAWINGS

Other objects and advantages of the present invention will become apparent to those skilled in the art upon reading the following detailed description of preferred embodiments, in conjunction with the accompanying drawings, wherein like reference numerals have been used to designate like elements, and wherein.

DETAILED DESCRIPTION OF THE PREFERRED EMBODIMENTS

Exemplary embodiments of the present invention are directed to a trimming circuit and method for replica type voltage regulators. According to an exemplary embodiment, a voltage regulator uses a tuning method to improve the power efficiency with better tuning range in replica type voltage regulators. Such a replica type voltage regulator is tuned in two sequential stages. The first stage is configured in a closed loop scheme, and is carried out by sliding the bulk of the native n-type metal oxide silicon (NMOS) device along the tap points of a potential divider circuit to any discrete voltage reference. The second stage is configured in a replica regulator scheme, and is carried out by sliding the bulk of the output transistor device along the same tap points of the potential divider circuit. The method of tuning the bulk of NMOS devices along a potential divider circuit improves the gate voltages of the output devices, thereby regulating the output voltage. The circuit and method according to exemplary embodiments provide an improved power-efficient tuning range for voltage regulators.

Figure 1:
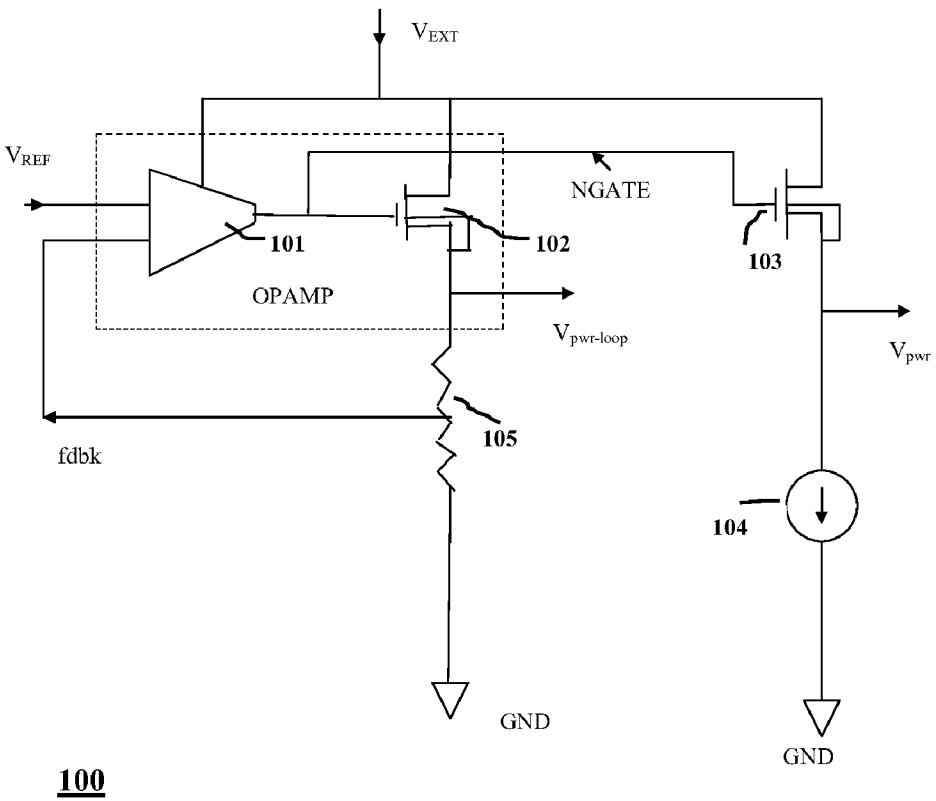
FIG. 1 (RELATED ART)
FIG. 1 illustrates a conventional replica type voltage regulator circuit using a resistor divider feedback network for trimming the output voltage.
Figure 2:
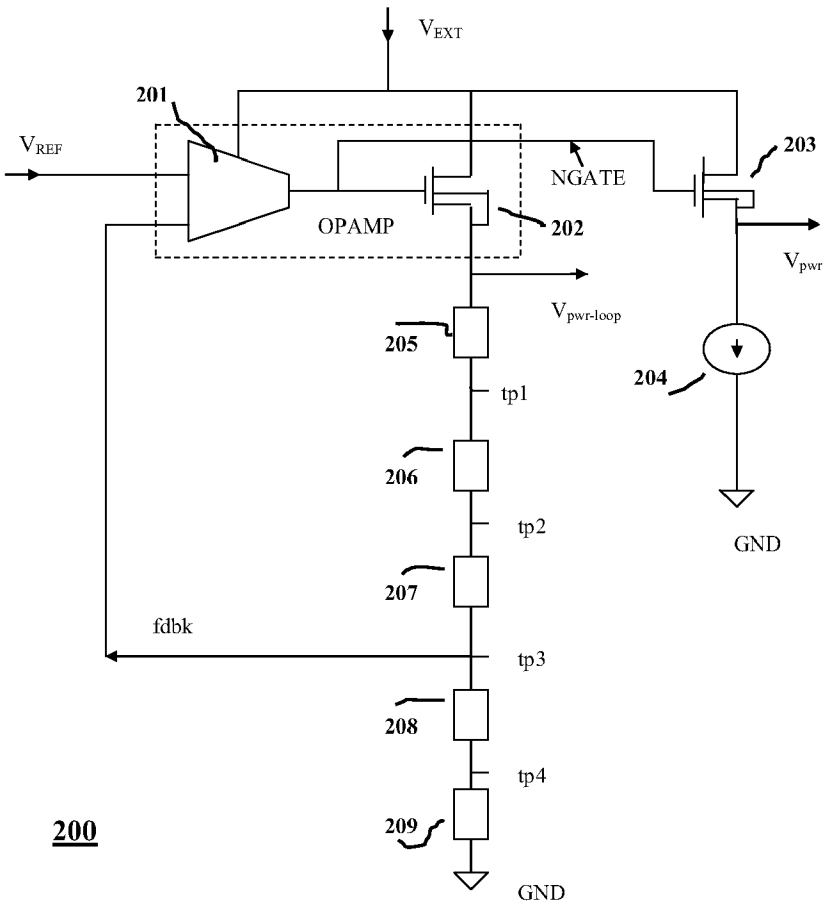
FIG. 2 (RELATED ART)
FIG. 2 illustrates a conventional replica type voltage regulator circuit using transistor feedback network for trimming the output voltage.
Figure 3:
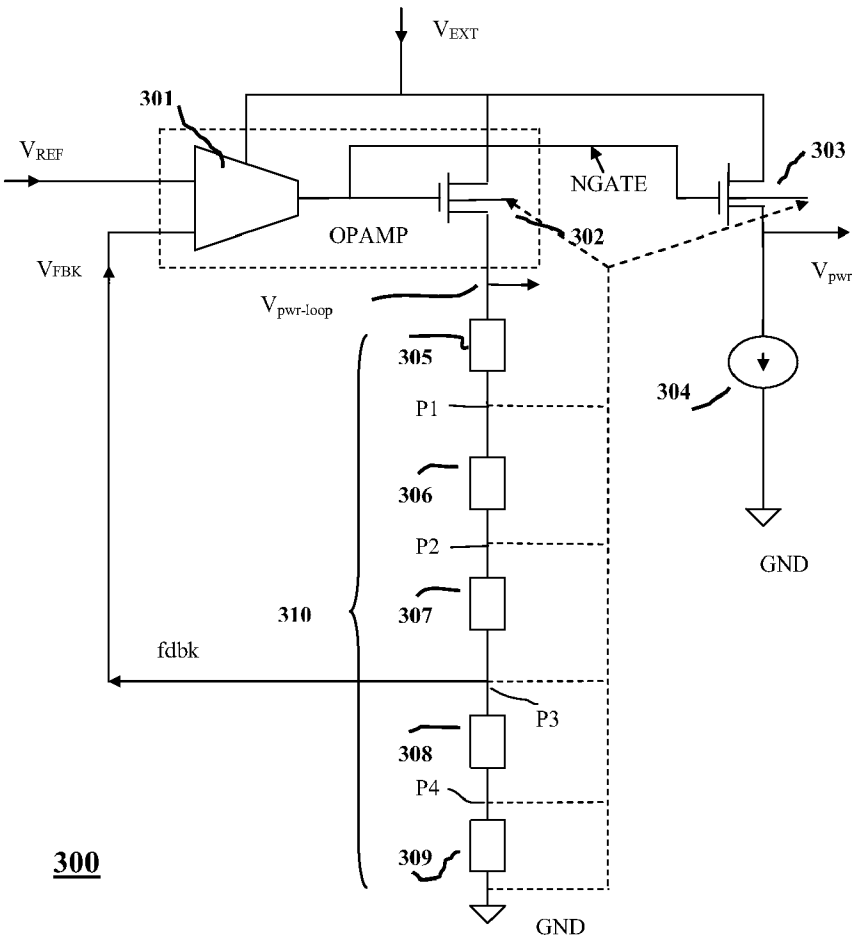
FIG. 3 illustrates a replica type voltage regulator circuit for trimming the output voltage by biasing the bulk of NMOS devices along a potential divider circuit, in accordance with an exemplary embodiment of the present invention.

These and other aspects and embodiments of the present now be described in greater detail. FIG. 3 illustrates a replica type voltage regulator circuit 300 for trimming the output voltage by biasing the bulk of NMOS devices along a potential divider circuit, in accordance with an exemplary embodiment of the present invention. The replica type voltage regulator circuit 300 comprises an operational amplifier (OPAMP) 301, the output of which is coupled to an NMOS device 302 to form an output stage of the OPAMP 301. The output of the OPAMP 301 is further coupled to a gate terminal or electrode of an output power transistor 303. Accordingly, the output signal NGATE of the OPAMP 301 drives the gate terminal of the output power transistor 303. The source terminal of the output power transistor 303 forms an output node for the output voltage ($V_{pwr}$) of the voltage regulator circuit 300, and is coupled to a current source 304 that forms an internal leakage path. The current source 304 is further coupled to a ground or other suitable reference voltage (GND). The common drain terminals of the OPAMP 301, NMOS device 302, and the output power transistor 303 are coupled together, and to a suitable external voltage ($V_{EXT}$).

The voltage regulator circuit 300 includes a potential divider circuit 310, one end of which is coupled to the source terminal of the NMOS device 302 to form an output loop node for the output loop voltage ($V_{pwr\text{-}loop}$) of the OPAMP 301. The potential divider circuit 310 comprises a series of discrete elements designated as 305, 306, 307, 308 and 309, although any suitable number of discrete elements can be used for the potential divider circuit 310. According to an exemplary embodiment, the series of discrete elements 305-309 can comprise, for example, suitable transistors or other like devices, although other appropriate types of discrete elements or devices can be used to populate the potential divider circuit 310. The potential divider circuit 310 includes tap points between consecutive discrete elements. For purposes of illustration and not limitation, the tap points are designated as P1, P2, P3 and P4 (e.g., tap point P1 is formed between discrete elements 305 and 306, tap point P2 is formed between discrete elements 306 and 307, tap point P3 is formed between discrete elements 307 and 308, and tap point P4 is formed between discrete elements 308 and 309), although the number of such tap points will depend on the number of discrete elements that form the potential divider circuit 310. The potential divider tap points P1-P4 are fed back to the OPAMP 301 in stages (along feedback path "fdbk") to form an amplifier-tuned (trimmable) closed loop path. The other end of the potential divider circuit 310 is coupled to a ground or other suitable reference voltage (GND).

In accordance with an additional exemplary embodiment of the present invention, the replica type voltage regulator circuit 300 can also include a triple well process scheme, in which the bulk (or body) of the native NMOS device 302 and the output power transistor 303 are tuned in steps along the potential divider circuit 310.

Referring to FIG. 3, the replica type voltage regulator circuit 300 comprises a reference voltage ($V_{REF}$) coupled to an input of the OPAMP 301. The OPAMP 301 is configured to compare the reference voltage $V_{REF}$ to the amplified feedback voltage ($V_{FBK}$) fed back via the closed loop path "fdbk" from the appropriate tap point P1, P2, P3, or P4 of the potential divider circuit 310 (in the illustration of FIG. 3, $V_{FBK}$ is fed back from tap point P3 merely for purposes of illustration and not limitation). In accordance with the results of the comparison, the NGATE signal output of the OPMAP 301 is varied as the potential divider circuit 310 is tuned (or trimmed) in step changes of the tap points P1-P4. The NGATE signal output further alters the OPAMP 301 output loop voltage ($V_{pwr\text{-}loop}$) and the output voltage ($V_{pwr}$). The output voltage ($V_{pwr}$) is further fine tuned by biasing the bulk of the NMOS device 302 and the output transistor 303 in steps along the tap points (P1 through P4) of the potential divider circuit 310. Such a method of trimming eliminates the course variations of the output voltage ($V_{pwr}$), and is made power efficient by not utilizing the load current source 304 for tuning.

Figure 4:
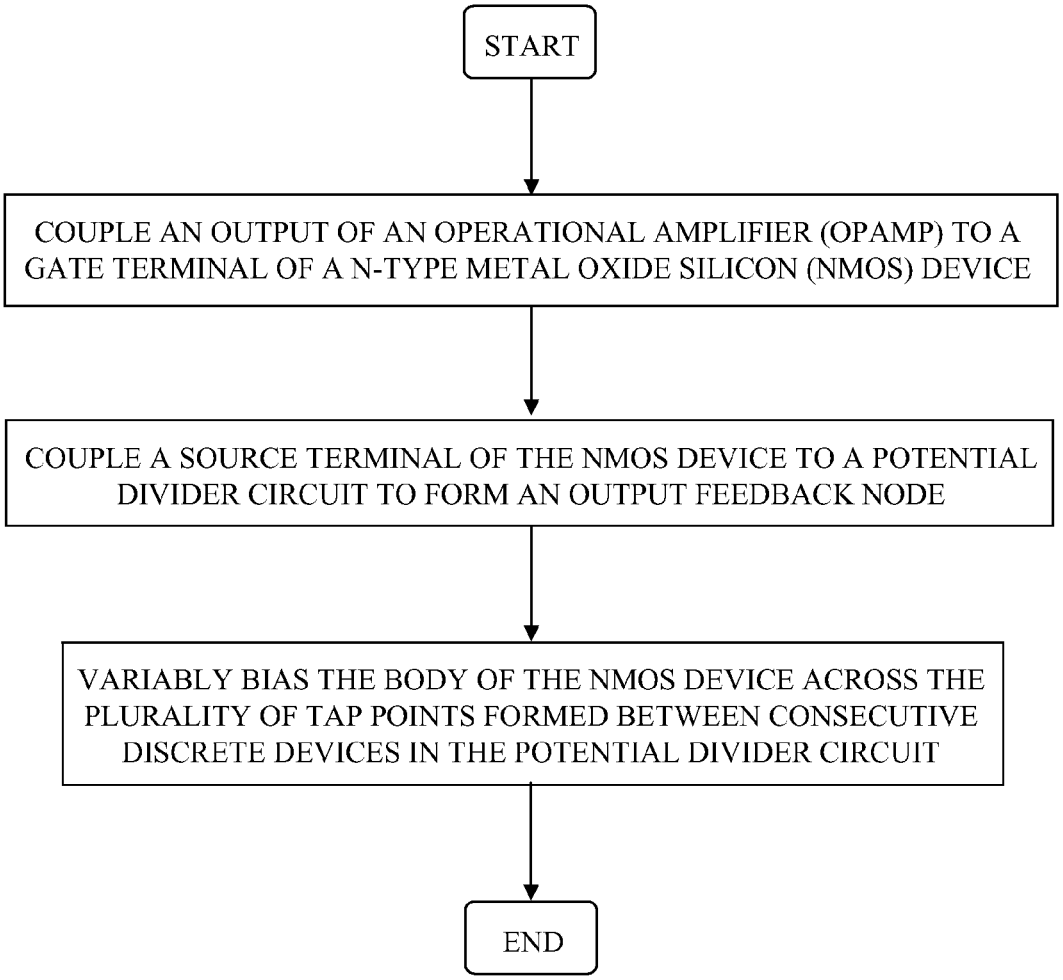
FIG. 4 is a flowchart illustrating steps for operating a voltage regulator, in accordance with an exemplary embodiment of the present invention.

FIG. 4 is a flowchart illustrating steps for operating a voltage regulator, in accordance with an exemplary embodiment of the present invention. In step 405, an output of an operational amplifier (OPAMP) is coupled to a gate terminal of a n-type metal oxide silicon (NMOS) device. In step 410, a source terminal of the NMOS device is coupled to a potential divider circuit to form an output feedback node. The potential divider circuit comprises a plurality of discrete devices coupled in series. In step 415, the body of the NMOS device is variably biased across the plurality of tap points formed between consecutive discrete devices in the potential divider circuit. According to an exemplary embodiment of the present invention, the plurality of discrete devices can comprise, for example, a plurality of transistor devices, although any suitable number and types of discrete devices or elements can be used to form the potential divider circuit.

According to an exemplary embodiment, the method can include the step of biasing the body of the NMOS device in steps along the plurality of tap points of the potential divider circuit to fine tune an output voltage of the voltage regulator. The method can include the steps of feeding back an output from a tap point formed between consecutive discrete devices to an input of the OPAMP as a feedback voltage, and configuring the feedback voltage by tuning a closed loop feedback node along the plurality of tap points of the potential divider circuit. The method can further include the steps of coupling a drain terminal of an output power transistor to common drain terminals of the OPAMP and the NMOS device, coupling a gate terminal of the output power transistor to an output of the OPAMP, and coupling a source terminal of the output power transistor to a current source to form an output node of the voltage regulator.

According to an exemplary embodiment, the method can include the step of variably biasing a body of the output power transistor across the plurality of tap points along the potential divider circuit. For example, the body of the output power, transistor cart be biased in steps along the plurality of tap points of the potential divider circuit to fine tune an output voltage of the voltage regulator circuit. The method can include the step of comparing a reference voltage and a feedback voltage from a tap point of the potential divider circuit to alter an output signal of the OPAMP. The output voltage at the output node formed by the output power transistor can be altered in accordance with the output signal, in which the output signal is applied to the gate terminal of the output power transistor. Additionally, the output voltage at the output feedback node associated with the NMOS device can be altered in accordance with the output signal, in which the output signal is applied to the gate terminal of the NMOS device.

Figure 5:
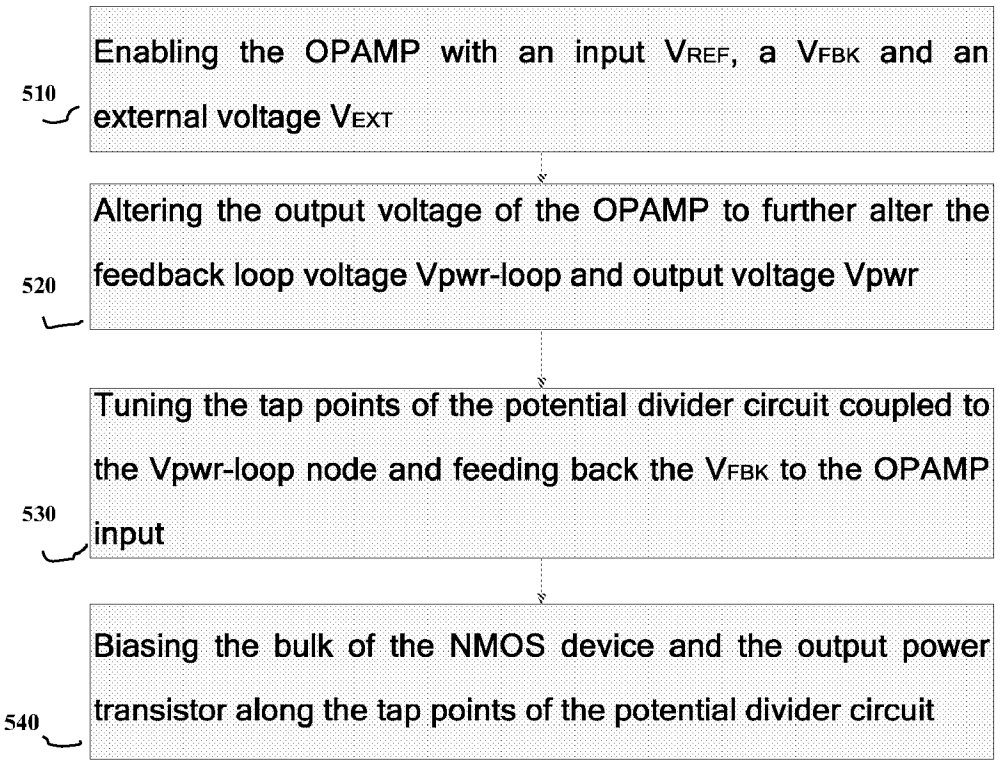
FIG. 5 is a flow chart illustrating steps for trimming the output of a replica type voltage regulator by biasing the bulk of transistor devices along a potential divider circuit, in accordance with an exemplary embodiment of the present invention.

FIG. 5 is a flowchart illustrating steps for trimming the output of a replica type voltage regulator by biasing the bulk of transistor devices along a potential divider circuit, in accordance with an exemplary embodiment of the present invention. In step 510, a voltage reference $V_{REF}$ is applied to an input of the OPAMP that is compared with a feedback voltage $V_{FBK}$ fed through the closed loop path from the potential divider circuit. An external voltage $V_{EXT}$ is also applied to the voltage regulator circuit, including the OPAMP. In step 520, the voltage at the output of the OPAMP (e.g., the NGATE signal) is varied in accordance with the changes in the OPAMP input to thereby vary both i.) the output loop voltage ($V_{pwr\text{-}loop}$) of the output loop node formed by the source terminal of the NMOS device and the potential divider circuit, and ii.) the output voltage ($V_{pwr}$) of the output node formed by the source terminal of the output power transistor. In step 530, the feedback closed loop along the tap points of the potential divider circuit is tuned, and the tuned feedback voltage $V_{FBK}$ is fed back to the OPAMP input. In step 540, the bulk of the output stage NMOS device and the output power transistor are biased along the tap points of the potential divider circuit to provide an additional tuning range for output voltage ($V_{pwr}$) regulation.

Exemplary embodiments of the present invention provide numerous advantages over conventional replica type voltage regulator circuits. For example, in the present invention, the step size of tuning is low due to the use of discrete elements, such as transistor devices or the like, in the potential divider circuit. Additionally, changing the body bias of the output device transistors limits the course variations in the output voltage ($V_{pwr}$). Furthermore, the present invention offers low power consumption, because the load current source is not used for tuning.

Exemplary embodiments of the present invention can be used in conjunction with any suitable type of replica type voltage regulator circuit in integrated circuit devices to provide an improved power-efficient tuning range for such voltage regulators.

Embodiments of the present invention are well suited to performing various other steps or variations of the steps recited herein, and in a sequence other than that depicted and/or described herein. In one embodiment, such a process can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. As used herein, a "computer-readable medium" can be any means that can contain, store, communicate, propagate, or transport the program for use by or in connection with the instruction execution system, apparatus, or device. The computer readable medium can be for example but not limited to, an electronic, magnetic, optical, electromagnetic, infrared, or semiconductor system, apparatus, device, or propagation medium. More specific examples (a non-exhaustive list) of the computer-readable medium can include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CDROM).

Details of the improved trimming method and circuit and the methods of designing and manufacturing the same that are widely known and not relevant to the present discussion have been omitted from the present description for purposes of clarity and brevity.

It should be appreciated that reference throughout the present specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more exemplary embodiments of the present, invention.

Similarly, it should be appreciated that in the foregoing discussion of exemplary embodiments of the invention, various features of the present invention are sometimes grouped together in a single embodiment, figure, or description thereof for the purpose of streamlining the disclosure to aid in the understanding of one or more of the various inventive aspects. Such a method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

It will be appreciated by those of ordinary skill in the art that the present invention can be embodied in various specific forms without departing from the spirit or essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

What is claimed is:

1. A voltage regulator circuit, comprising:

an operational amplifier (OPAMP);

a n-type metal oxide silicon (NMOS) device, wherein an output of the OPAMP is coupled to a gate terminal of the NMOS device; and a potential divider circuit comprising a plurality of discrete devices coupled in series, wherein a source terminal of the NMOS device is coupled to the potential divider circuit to form an output feedback node, and wherein a body of the NMOS device is biased variably across a plurality of tap points formed between consecutive discrete devices in the potential divider circuit.

2. The voltage regulator of claim 1, wherein the body of the NMOS device is biased in steps along the plurality of tap points of the potential divider circuit to fine tune an output voltage of the voltage regulator circuit.

3. The voltage regulator circuit of claim 1, wherein the plurality of discrete devices comprises a plurality of transistor devices.

4. The voltage regulator circuit of claim 1, wherein an output from a tap point formed between consecutive discrete devices is fed back to an input of the OPAMP as a feedback voltage.

5. The voltage regulator circuit of claim 4, wherein the feedback voltage is configurable by tuning a closed loop feedback node along the plurality of tap points of the potential divider circuit.

6. The voltage regulator of claim 1, comprising:

an output power transistor, wherein the output power transistor comprises a drain terminal coupled to common drain terminals of the OPAMP and the NMOS device, wherein a gate terminal of the output power transistor is coupled to an output of the OPAMP, and wherein a source terminal of the output power transistor is coupled to a current source to form an output node of the voltage regulator circuit.

7. The voltage regulator circuit of claim 6, wherein a body of the output power transistor is biased variably across the plurality of tap points along the potential divider circuit.

8. The voltage regulator circuit of claim 7, wherein the body of the output power transistor is biased in steps along the plurality of tap points of the potential divider circuit to fine tune an output voltage of the voltage regulator circuit.

9. The voltage regulator circuit of claim 6, wherein the OPAMP is configured to compare a reference voltage and a feedback voltage from a tap point of the potential divider circuit to alter an output signal of the OPAMP.

10. The voltage regulator circuit of claim 9, wherein the output signal is applied to the gate terminal of the output power transistor, and wherein the output signal is configured to alter an output voltage at the output node.

11. The voltage regulator circuit of claim 9, wherein the output signal is applied to the gate terminal of the NMOS device, and wherein the output signal is configured to alter an output voltage at the output feedback node associated with the NMOS device.

12. A method of operating a voltage regulator, comprising the steps of:

a.) coupling an output of an operational amplifier (OPAMP) to a gate terminal of a n-type metal oxide silicon (NMOS) device;

b.) coupling a source terminal of the NMOS device to a potential divider circuit to form an output feedback node, wherein the potential divider circuit comprises a plurality of discrete devices coupled in series; and c.) variably biasing a body of the NMOS device across a plurality of tap points formed between consecutive discrete devices in the potential divider circuit.

13. The method of claim 12, comprising the step of:

biasing the body of the NMOS device in steps along the plurality of tap points of the potential divider circuit to find tune an output voltage of the voltage regulator.

14. The method of claim 12, wherein the plurality of discrete devices comprises a plurality of transistor devices.

15. The method of claim 12, comprising the step of:

feeding back an output from a tap point formed between consecutive discrete devices to an input of the OPAMP as a feedback voltage.

16. The method of claim 15, comprising the step of:

configuring the feedback voltage by tuning a closed loop feedback node along the plurality of tap points of the potential divider circuit.

17. The method of claim 12, comprising the steps of:

coupling a drain terminal of an output power transistor to common drain terminals of the OPAMP and the NMOS device;

coupling a gate terminal of the output power transistor to an output of the OPAMP; and coupling a source terminal of the output power transistor to a current source to form an output node of the voltage regulator.

18. The method of claim 17, comprising the step of:

variably biasing a body of the output power transistor across the plurality of tap points along the potential divider circuit.

19. The method of claim 18, comprising the step of:

biasing the body of the output power transistor in steps along the plurality of tap points of the potential divider circuit to fine tune an output voltage of the voltage regulator circuit.

20. The method of claim 17, comprising the step of:

comparing a reference voltage and a feedback voltage from a tap point of the potential divider circuit to alter an output signal of the OPAMP.

21. The method of claim 20, comprising the step of:

altering an output voltage at the output node in accordance with the output signal, wherein the output signal is applied to the gate terminal of the output power transistor.

22. The method of claim 20, comprising the step of:

altering an output voltage at the output feedback node associated with the NMOS device in accordance with the output signal, wherein the output signal is applied to the gate terminal of the NMOS device.

* * * * *